US008048191B2

(12) United States Patent
Lu et al.

(10) Patent No.: US 8,048,191 B2
(45) Date of Patent: Nov. 1, 2011

(54) COMPOUND MAGNETIC POWDER AND MAGNETIC POWDER CORES, AND METHODS FOR MAKING THEM THEREOF

(75) Inventors: Zhichao Lu, Beijing (CN); Deren Li, Beijing (CN); Shaoxiong Zhou, Beijing (CN); Caowei Lu, Beijing (CN); Feng Guo, Beijing (CN); Jianliang Li, Beijing (CN); Jun Wang, Beijing (CN); Tongchun Zhao, Beijing (CN); Liang Zhang, Beijing (CN)

(73) Assignees: Advanced Technology & Material Co., Ltd., Beijing (CN); Central Iron & Steel Research Institute, Beijing (CN)

( * ) Notice: Subject to any disclaimer, the term of this patent is extended or adjusted under 35 U.S.C. 154(b) by 709 days.

(21) Appl. No.: 11/610,511

(22) Filed: Dec. 14, 2006

(65) Prior Publication Data

US 2007/0144614 A1 Jun. 28, 2007

(30) Foreign Application Priority Data

Dec. 28, 2005 (CN) ..... 2005 1 0132500
Aug. 4, 2006 (CN) ..... 2006 1 0089121

(51) Int. Cl.
*H01F 1/33* (2006.01)
*H01F 3/08* (2006.01)
*C22C 45/02* (2006.01)

(52) U.S. Cl. ..... 75/255; 148/105; 148/403

(58) Field of Classification Search ..... 148/104, 148/105, 304, 306, 307, 309, 310; 75/255, 75/252

See application file for complete search history.

(56) References Cited

U.S. PATENT DOCUMENTS 1,669,642 A 5/1928 Andrews (Continued)

FOREIGN PATENT DOCUMENTS

CN 1373481 A 10/2002

(Continued)

OTHER PUBLICATIONS

English translation of Shimoda JP 2001-068324, published Mar. 16 2001, 28 pages.*

(Continued)

*Primary Examiner* — George Wyszomierski
*Assistant Examiner* — Mark L Shevin
(74) *Attorney, Agent, or Firm* — Perkins Coie LLP; Aaron Wininger

(57) ABSTRACT

The present invention provides a compound powder for making magnetic powder cores, a kind of magnetic powder core, and a process for making them. Said compound powder is a mixture composing of powder A and powder B, the content of powder A is 50-96 wt % and the content of powder B is 4-50 wt %, wherein powder A is at least one selected from iron powder, Fe—Si powder, Fe—Si—Al powder, Fe-based nanocrystalline powder, Fe-based amorphous powder, Fe—Ni powder and Fe—Ni—Mo powder; powder B bears different requirement characteristics from powder A and is at least one selected from iron powder, Fe—Si powder, Fe—Si—Al powder, Fe-based nanocrystalline powder, Fe-based amorphous powder, Fe—Ni powder and Fe—Ni—Mo powder. Said powder B adopts Fe-based amorphous soft magnetic powder with good insulation property as insulating agent and thus core loss of magnetic powder core decreases. The decrease of magnetic permeability of magnetic powder core resulting from a traditional insulating agent is remedied and the initial magnetic permeability of magnetic powder core is improved by taking advantage of soft magnetic properties of Fe-based amorphous powder.

8 Claims, 9 Drawing Sheets

U.S. PATENT DOCUMENTS

| | | | | |
|---|---|---|---|---|
| 6,331,270 | B1 * | 12/2001 | Lefebvre et al. | 419/27 |
| 6,432,159 | B1 * | 8/2002 | Saito et al. | 75/255 |
| 6,594,157 | B2 | 7/2003 | Yoshida et al. | |
| 6,827,557 | B2 | 12/2004 | Kim | |
| 7,170,378 | B2 * | 1/2007 | Fujiwara et al. | 336/83 |
| 2009/0320961 | A1 * | 12/2009 | Brunner | 148/104 |

FOREIGN PATENT DOCUMENTS

| | | | |
|---|---|---|---|
| CN | 1487536 | A | 4/2004 |
| JP | 08-037107 | | 2/1996 |
| JP | 2001-068324 | * | 3/2001 |
| JP | 2001-196216 | * | 7/2001 |
| WO | WO 2005/020252 | * | 3/2005 |
| WO | WO 2005/020252 | A1 * | 3/2005 |

OTHER PUBLICATIONS

English translation of JP '216 to Yasuo Shimoda, JP 2001-196216, published Jul. 19, 2001, 9 pages.*

* cited by examiner

COMPOUND MAGNETIC POWDER AND MAGNETIC POWDER CORES, AND METHODS FOR MAKING THEM THEREOF

RELATED TECHNICAL FIELD

The present invention, subject to magnetic functional material field, relates to a compound powder for making magnetic powder core, magnetic powder core and the methods for making them.

PRIOR ART

As to known technology, metallic magnetic powder cores, mainly include iron powder cores, Fe—Si powder cores, Sendust cores, Hi-Flux cores, MPP cores, amorphous magnetic powder cores, and nanocrystalline magnetic powder cores. With different characteristics of their own, these magnetic powder are for making different fields.

The existing technical documentations related to the present invention include:

Patent document 1: Chinese Invention Patent Publication CN1373481A (Priority right: KR 2001-0000491/KR 2001-0007782)

Patent document 2: Chinese Invention Patent Publication CN1487536A (Priority right: JP 2002-265549/JP 2003-1011836)

Patent document 3: U.S. Pat. No. 6,827,557

Patent document 4: U.S. Pat. No. 6,594,157

Patent document 5: U.S. Pat. No. 1,669,642

Patent document 6: Japanese Patent No. JP08-037107

Iron powder core was the first metal magnetic powder core, with iron content usually more than 99 wt % and the maximum magnetic permeability is around 90. The major characteristic includes low price, high core loss, and fine temperature stability. Since the raw materials is cheap, iron powder core is widely used in low-cost fields, wherein the most widely used field is expendable goods.

Fe—Si powder core usually contains less than 10 wt % of silicon and the maximum magnetic permeability is a little higher than iron powder core, thus it has excellent inductance stability under DC bias field and is widely for making large DC bias field.

Sendust powder core is a magnetic powder core with high price performance ratio, wherein it contains 10-15 atomic percent of silicon and aluminum and the rest is iron (referring to Japanese Patent No. JP 08-037107). The maximum magnetic permeability reaches 125. Comparing with iron powder core though, Sendust powder core is more expensive, it has lower core loss and higher maximum magnetic permeability. Due to low magnetostrictive coefficient and low noises during operation, said powder core is widely used as EMI inductor.

Hi-Flux powder core usually contains 50 at % of iron and 50 at % of nickel (referring to U.S. Pat. No. 1,669,642). The maximum magnetic permeability reaches at 160. The operating point designed for Hi-Flux core is about 6500 Gauss, thus Hi-Flux core has the best inductance stability under DC bias field. Currently, it is mainly used as an energy storage inductor and scanning transformer, especially suitable for DC and linear frequency noise filter inductance (e.g. DM inductor etc. for switching power supply). Comparing with Fe—Si—Al powder core, Hi-Flux core has higher operating point, large resistance to DC bias field and it is more expensive.

The compositions by atomic percent of MPP powder core is usually $Fe_{17}Ni_{81}Mo_2$ and the maximum magnetic permeability reachs at over 500. It has the widest range of magnetic permeability among all magnetic powder cores. MPP core is characterized in excellent temperature stability, low core loss, small operating noise, and high operating point. The synthetic properties of MPP core are the best among the existing magnetic powder cores currently and it is also the most expensive one as well.

Nanocrystalline magnetic powder core mostly adopts FeCuNbSiB series nanocrystalline alloy (referring to Chinese Invention Patent Publication No. CN1373481A, U.S. Pat. No. 6,827,557), wherein the compositions of atomic percent satisfy: Fe is 70-75%, NbCu is 4%, SiB is 26-21% and the maximum magnetic permeability reaches 120. Nanocrystalline magnetic powder core has excellent frequency stability and high magnetic permeability. Since the powder is usually obtained by ball-milling the namocrystalline ribbon, the heteromorphosis problem exists in the powder, insulation is difficult and core loss is high.

Amorphous magnetic powder cores mainly adopt Fe-based bulk amorphous systems. Usually the content of Fe content usually is 70-75 at % by atomic percent; the rest is amorphous forming elements such as P, Si, B, C, Al, etc. and a proportion of antioxidation elements such as Cr, Mo, etc. (referring to Chinese Invention Patent Publication No. CN1487536A, U.S. Pat. No. 6,594,157). The magnetic permeability of Fe-based amorphous magnetic powder core is low and currently reaches up to 100, where the core loss is the lowest of all magnetic powder cores.

To sum up, existing magnetic powder core products have different performance characteristics of their own and large differences in price and various different application fields. On the whole, there are imperfections in performance and there is still some room to improve; the price, especially for Hi-FluxP core and MPP core, is high and there is still much room to decrease.

To be specific, the current major technology adopted by making metallic magnetic powder cores currently is: 1. screening powder; 2. mixing with insulating agent; 3. press-molding; 4. annealing; 5. spray-painting. The insulating agent adopted in the technology usually is metal oxide, silicates, mineral substances, resins etc. with good insulating property. The function of the insulating agent is to isolate metallic powder, thus high core loss results from contact between metal powder and rapid decrease of magnetic permeability with the increase of frequency is avoided. Since it has no magnetic properties in itself, the content of the insulating agent generally is moderate, from 1 wt % to 5 wt %. If too little insulating agent is provided, insulation effect is difficult to be achieved; while too much insulating agent results in the decrease of magnetic permeability of magnetic powder core and the decrease of density. That is to say, the supplement of insulating agent in preparing magnetic powder cores currently causes the loss of magnetic permeability to some extent. The limit to filled quantity results in deficient of insulating effect, thus the core loss does not get at a lower point.

SUMMARY OF THE INVENTION

The present invention aims to provide a compound powder for making magnetic powder cores prepared by mixing two or more kinds of metallic alloy powder and a method for making magnetic powder core to overcoming the imperfections in other requirements for traditional magnetic powder cores while using a single powder to prepare it, to prepare a powder of magnetic powder core and the magnetic powder core with integrated and overall requirement characteristics.

Another aim of the present invention is to provide the low core loss magnetic powder core, wherein the magnetic permeability and the core loss is improved simultaneously by overcoming the problem that magnetic permeability of magnetic powder core decreases when non-magnetic insulating material is added as an insulating agent in order to decrease core loss from traditional magnetic powder cores.

In order to achieve the aims mentioned above, the present invention provides the technical solution as follows:

In one aspect, the present invention provides a compound powder for making magnetic powder cores and said compound powder is a uniform mixture of powder A and powder B, wherein the content of powder A is 50-96 wt % and the content of powder B is 4-50 wt %, wherein:

Powder A is selected from iron powder, Fe—Si powder, Fe—Si—Al powder, Fe-based nanocrystalline powder, Fe-based amorphous powder, Fe—Ni powder and Fe—Ni—Mo powder and has priority to satisfy in requirement characteristic;

Powder B bears different requirement characteristic from powder A and is at least one powder selected from iron powder, Fe—Si powder, Fe—Si—Al powder, Fe-based nanocrystalline powder, Fe-based amorphous powder, Fe—Ni powder and Fe—Ni—Mo powder. Said requirement characteristic is one of magnetic permeability, core loss, magnetic permeability at high frequency, inductance stability under DC bias field, temperature stability and cost.

In the other aspect the present invention provides a method powder for making low core loss magnetic powder core, and it is a uniform mixture of powder A and powder B, wherein the content is of powder A is 80-96 wt % and the content of powder B is 4-20 wt %, wherein: powder A is one powder selected from iron powder, Fe—Si powder, Fe—Si—Al powder, Fe-based nanocrystalline powder, Fe-based amorphous powder, Fe—Ni powder and Fe—Ni—Mo powder and has priority to satisfy the requirement characteristic; powder B is Fe-based amorphous soft magnetic powder with good insulating effect.

In the third aspect, the present invention provides a method for preparing a compound powder for making magnetic powder core, the method comprising the following steps: a. Preparing powder A and powder B respectively according to different characteristics; b. Screening prepared powder A and powder B, respectively; c. Annealing powder A and powder B according to the optimum technologies and parameters; d. Uniformly mixing powder A with powder B, the content of is: powder A is 50-96 wt % and the content of powder B is 4-50 wt %, wherein powder A is one powder selected from iron powder, Fe—Si powder, Fe—Si—Al powder, Fe-based nanocrystalline powder, Fe-based amorphous powder, Fe—Ni powder and Fe—Ni—Mo powder and has priority to satisfy the requirement characteristics; powder B bears different requirement characteristics from powder A and is at least one powder selected from iron powder, Fe—Si powder, Fe—Si—Al powder, Fe-based nanocrystalline powder, Fe-based amorphous powder, Fe—Ni powder and Fe—Ni—Mo powder.

In the fourth aspect, the present invention provides a method for preparing a compound powder for making low core loss magnetic powder core.

In the fifth aspect, the present invention provides a magnetic powder core and a method for preparing it, comprising the magnetic powder core in composed of 0.2-7 wt % of insulating agent, 0.1-5 wt % of adhesive, 0.01-2 wt % of lubricant, the rest for said compound powder. Said dried powder is pressed under a pressure of 500 MPa-3000 MPa to prepare magnetic powder core and then the magnetic powder core is annealed and spray-painted.

In the sixth aspect, the present invention provides a low core loss magnetic powder core and a method for preparing it, the magnetic powder core in composed of 4-20 wt % of insulating agent, wherein said insulating agent is Fe-based amorphous soft magnetic powder with insulating property; 0.1-5 wt % of adhesive, the rest for one powder selected from iron powder, Fe—Si powder, Fe—Si—Al powder, Fe-based nanocrystalline powder, Fe-based amorphous powder, Fe—Ni powder and Fe—Ni—Mo powder. The said powder is uniformly mixed with adhesive and then the resultant mixture is dried. Lubricant is added into the dried powder and then the dried powder is put into a mold of magnetic powder core and molded under a pressure of 500 MPa-3000 MPa. The last step is to anneal the molded magnetic powder core and spray-paint magnetic powder core.

In conclusion, the technical solutions provided by the present invention carry out the improvements as follows:

Compound Powder for Making Magnetic Powder Core

The compound powder for making magnetic powder core is prepared by uniformly mixing two or more kind of powder selected from iron powder, Fe—Si powder, Fe—Si—Al powder, Fe-based nanocrystalline powder, Fe-based amorphous powder, Fe—Ni powder and Fe—Ni—Mo powder. The magnetic powder core is prepared by adopting the method for preparing magnetic powder core. To be specific, two or more kind of powder with complementarities in properties and prices selected from iron powder, Fe—Si powder, Fe—Si—Al powder, Fe-based nanocrystalline powder, Fe-based amorphous powder, Fe—Ni powder and Fe—Ni—Mo powder are mixed to prepare compound powder for making magnetic powder core and the magnetic powder core is prepared by adopting the preparation technology for making magnetic powder core.

The characteristics of magnetic powder core in the present invention are realized by the following methods: 1. keeping operational performance and decreasing price. 2. improving operational performance and keeping or decreasing price. 3. substantially improving operational performance and increasing price slightly. 4. substantially decreasing price and decreasing operational performance slightly. To be more specific, the compound powder for the present invention is prepared by uniformly mixing at least one powder selected from iron powder, Fe—Si powder, Fe—Si—Al powder, Fe-based nanocrystalline powder, Fe-based amorphous powder of lower cost with Fe—Ni powder and Fe—Ni—Mo powder of higher cost. The cost of said compound powder is much lower than that of Fe—Ni powder and Fe—Ni—Mo powder and has more excellent performance and higher ratio of performance to price as well. The compound powder for the present invention is also prepared by mixing Fe-based amorphous powder that has the higher quality factor of its magnetic powder core in high frequency with iron powder, Fe—Si powder, Fe—Si—Al powder, Fe-based nanocrystalline powder that has the lower quality factor of other magnetic powder core in high frequency. Comparing with the magnetic powder core prepared by the original powder, the price of magnetic powder core prepared by the compound powder keeps the same or increases a little, but the quality factor of its magnetic powder core in high frequency increases effectively, thus the magnetic powder core has excellent properties thereof.

While the compound magnetic powder core for the present invention is prepared by mixing two or more powder, the weight percentage of the powder satisfies, except for the powder with maximum weight percentage, the summation of the weight percentage of the powder for the rest is not less than 4 wt %. If the content of the lesser powder is too few, the complementary advantages of the compound magnetic powder core is difficult to taken and characteristics are difficult to be improved. The content of powder B in the compound magnetic powder core for the present invention is preferably great than 10 wt %, more preferably great than 20 wt %.

Method for Preparing Compound Magnetic Powder Core

The following steps are included:

1. Preparing powder;
2. Screening powder and testing properties;
3. Annealing powder;
4. Mixing powder;
5. Mixing the compound powder with insulating agent, adhesive and lubricant and then drying them until fully dry;
6. Press-molding powder to prepare magnetic powder core;
7. Annealing magnetic powder core;
8. Spray-painting magnetic powder core;

Step 1 Preparing Powder

In the compound powder for the present invention, the original powder can be prepared by conventional technologies. For instance, amorphous powder is prepared by atomization method and nanocrystalline powder is prepared by attrition method.

Step 2 Screening Powder

The powder for the present invention is screened by test sieve, standard spanking vibration sieve, other types of vibration sieves and pneumatic powder classifier equipments.

Step 3 Annealing Powder Core Respectively

The compound powder for making magnetic powder core for the present invention comprises two or more kinds of powder. Since the powder can not annealed be treated separately after mixing, various kinds of powder are fully annealed before mixing so that the magnetic properties of all kinds of powder are optimal. For instance, the water atomized amorphous powder is mixed with MPP prepared by crushing method. The annealing temperature of MPP is greater than 600° C., while the temperature for annealing amorphous powder is under crystallization temperature, usually no more than 500° C. In order to prevent the powder from oxidation during annealing, the present invention is preferably implemented in vacuum condition or protective atmosphere. However, after the two kinds of powder are mixed, it is difficult to make both of them in optimal magnetic properties simultaneously by annealing. Therefore, during the process of making magnetic powder core, different kinds of powder are annealed respectively by according to their optimal annealing technology.

Step 4 Mixing Powder

The compound powder for making magnetic powder core in the present invention is prepared by mixing more than two kinds of powder, wherein the uniformity of mixture exerts direct influence on the properties of magnetic powder core. If the mixture is not uniform, the advantages of compound powder can not be taken. Therefore, a proper mixing time is needed during mixing and the mixing time ranges from 1 minute to 60 minutes. If the mixing time is less than 1 minute, it is difficult to uniformly mix the powder; while if the mixing time is more than 60 minutes, the uniformity does not increase but decrease instead.

Step 5 Components in Magnetic Powder Core

In order to increase the resistivity of magnetic powder core, reduce eddy current loss and increase magnetic permeability in high frequency, the present invention preferably selects the following types of insulating agent to mix with compound powder: 1. oxide powder, such as $SiO_2$, CaO, $Al_2O_3$, $TiO_2$, etc., oxide powder usually has the advantages of stable properties, high insulation and heat-resistant property and low cost. 2. silicates, phosphates, etc. 3. other mineral powder, such as mica powder, kaolinite, etc. 4. surface film formed or surface oxide occurred chemically.

While said insulating agent is used to insulate the compound powder, the weight percentage of insulating agent should be between 0.2 wt % and 7 wt % of the total mixture weight. If insulating agent is too little, compound powder is difficult to be fully isolated, thus resulting in more contact surface; or if insulating layer is too thin, the layer is easy to breakdown, thus losing insulation effect under the action of electromagnetic induction, which causes high core loss of magnetic powder core and low magnetic permeability in high frequency. If too much insulating agent is added, the gap between powder is too large, resulting in the decrease of magnetic permeability of magnetic powder core. The weight percentage of insulating agent is more preferably from 0.5 wt % to 5 wt %.

The following types of adhesive substances are preferable to serve as the adhesive for the present invention: 1. organic adhesive, such as epoxy resin, has been commonly for making industrial world as adhesive materials and the mixture of organic adhesive with curing agent has better effect on sticking. 2. inorganic adhesive, such as phosphates, etc., inorganic adhesive have the advantages of good heat-resistant property and excellent insulating effect in itself and dual functions of insulation and sticking, and an additional amount makes the powder fully adhesive.

The content of adhesive accounts for 0.1-5 wt % of total mixture while using said adhesive. If too much adhesive is added, properties of magnetic powder core decrease. If the content of adhesive is too low, there is no effect on sticking.

The mixture of lubricant functions as: 1. the powder is easy to flow while press-molding, thus the density of magnetic powder core increases; 2. magnetic powder core is not prone to stick with pressing mold, thus demoulding becomes easier. Stearates, talc powder, etc. are preferably selected as lubricant for the present invention, wherein the content is no more than 2 wt % of total weight of mixture. If too much lubricant is provided, the density of magnetic powder core decreases, resulting in the deterioration of the magnetic properties and reduction of magnetic permeability.

In order to obtain fully insulated and uniformly mixed compound magnetic powder, the insulating agent, adhesive and lubricant preferably range from 0.5 wt % to 10 wt % of total weight of mixture for the present invention; more preferably from 1 wt % to 7 wt %.

Step 6 Press-Molding

The molding pressure of the compound powder for the present invention is preferably from 500 MPa to 3000 MPa. If the pressure is less than 500 MPa, the powder is difficult to be molded or cracks exists after molding, magnetic permeability is low and other properties of magnetic powder core are not fine. If the pressure is over 3000 MPa, withstand pressure of mold is large, thus the mold is easy to be destroyed, and moreover, the powder is difficult to be insulated, core loss of powder core is high and quality factor is low. The molding pressure of magnetic powder core is more preferably from 800 MPa to 2500 MPa.

Step 7 Annealing Magnetic Powder Core

Stress inevitably exists inside magnetic powder core during the process of preparing compound magnetic powder core under the action of pressure and these stresses influences the properties of magnetic powder core. The internal stress can be eliminated and the magnetic properties can be improved by annealing compound magnetic powder core. The annealing temperature of compound magnetic powder core satisfies the requirements of: 1. annealing temperature is suitable for two kinds of powder at the same time. For instance, if nanocrystalline powder is contained in the powder, the annealing temperature of the powder is no more than the secondary crystallization temperature of nanocrystalline powder. 2. annealing temperature is as high as possible within the limit of first requirement. Since if the annealing temperature of powder core is too low, the internal stress in powder core can not be effectively eliminated and the magnetic properties can not be improved. Generally speaking, in order to effectively eliminate the internal stress, the annealing temperature is more than 350° C. 3. annealing temperature can not be too high, otherwise the insulating and adhesive substances lose their original functions.

For instance, while epoxy resin is used as adhesive substance, epoxy resin is easy to invalidate at 500° C. the adhesive strength of powder decreases, magnetic powder core is easy to break, insulating effect is not fine and quality factor decreases. Therefore, the annealing temperature of powder core is preferably below 600° C. The annealing time for compound powder core satisfies the requirements of: 1. the annealing time of powder core is less than 5 hours since too long annealing time results in low effectiveness and more manufacture cost. 2. the annealing time of powder core is more than 5 minutes since the properties of magnetic powder core are not uniform if annealing time is too short. 3. the annealing time of powder core is preferably between 30 minutes and 90 minutes. For the present invention, the annealing process mentioned above should preferably be implemented in protective atmosphere, including vacuum condition, hydrogen, nitrogen or argon atmosphere.

Step 8 Spray-Painting Magnetic Powder Core

In order to protect magnetic powder core from powder dropping and being eroded by air and from the deterioration of magnetic properties, the magnetic powder core is protected by spray-painting. The spray-painting materials is preferably selected epoxy resin or mixture of epoxy resin and estrodur which has relative small curing stress. The thickness of spray-painting is preferably from 50 μm to 300 μm.

Furthermore, according to the principle of compound powder core mentioned above, the inventor for the present invention especially puts forward a technical solution for preparing low core loss magnetic powder core, i.e., a low core loss magnetic powder core and a method for making it as follows:

Principle of Low Core Loss Magnetic Powder Core

The compound powder for making low core loss magnetic powder core in the present invention is a mixture of powder A and powder B. The content of powder A is 80-96 wt % and the content of powder B is 4-20 wt %, wherein powder A is one selected from iron powder, Fe—Si powder, Fe—Si—Al powder, Fe-based nanocrystalline powder, Fe-based amorphous powder, Fe—Ni powder and Fe—Ni—Mo powder and has priority to satisfy the requirement characteristics; powder B is Fe-based amorphous soft magnetic powder with good insulating property.

Wherein, the Fe-based amorphous soft magnetic powder with fully oxidated surface and insulation effect is adopted for low core loss magnetic powder core as insulating agent. The functions exhibits in two aspects: one is to function as insulation substances and the other is to function as the soft magnetic powder used in magnetic powder core.

Wherein, Fe-based amorphous soft magnetic powder is used as insulating agent. The compositions of said Fe-based amorphous soft magnetic powder satisfy $(Fe_{1-x}M_x)_{100a-b-c}P_aT_bD_c$; wherein M represents at least one element of Co and Ni; T is more than three elements selected from Al, C, B, Si D is at least one element selected from Sn, Cr, Mn, Mo, W, V, Nb, Ta, Ti, Zr, Hf, Pt, Pd, Au; x is from 0.01 to 0.16; a is from 8 to 15; b is from 10 to 25; c is from 0.5 to 6, and all by atomic percentage. Said powder has large glass forming ability and is manufactured on a large scale by water atomization method.

The oxygen content of Fe-based amorphous soft magnetic powder is 4000 ppm-<20000 ppm, wherein if the content is less than 4000 ppm, insulation effect is not achieved; while if more than 20000 ppm, magnetic properties are influenced. When initial permeability $\mu_i$>30000 and coercive force $H_C$<70A/m (Table A), soft magnetic properties are very good. Fe-based amorphous soft magnetic powder is used as insulating agent, which, on one hand, insulates magnetic powder and decrease the core loss of magnetic powder core, on the other hand, which remedies the imperfectness of the decrease of the magnetic permeability of magnetic powder core caused by traditional insulating agent and improves the initial magnetic permeability of magnetic powder core by taking advantage of the good soft magnetic properties. The content of insulating agent is 4-20 wt %, wherein if the content is less than 4 wt %, the insulating agent does not function, while if more than 20 wt %, magnetic properties of magnetic powder core of powder A deteriorate.

As to the process for forming the insulated surface, many preparation technologies can be adopted, which includes but is not limited to preparing by adopting water atomizing technology, preparing by adopting water vapor atomizing technology and decreasing mean particle size of said powder.

The mean particle size ratio of powder B to powder A is ½~1/20, thus the particle of powder B fills in the holes among powder A effectively and the density of magnetic powder core increases.

TABLE A

Basic properties of Fe-based amorphous powder

| Material | Initial Permeability | Coercive Force | Curie Temperature | Crystallization Temperature |
|---|---|---|---|---|
| Fe-based amorphous powder | >30000 | <70 (A/m) | 353.1-355.2° C. | 480.0-481.3° C. |

Method for Making Low Core Loss Magnetic Powder Cores

The procedures are as follows:

① Uniformly mixing dried amorphous powder as insulating agent with magnetic powder;

② With the help of a cosolvent [such as alcohol or water], adhesive first dissolves into liquor, then the mixed powder in step CD is thoroughly put into the adhesive liquor, wherein the proportion between the liquor and the powder mixed is 13 ml/30 g; then the resultant mixture is fully stirred in emulsification equipment, wherein the stirring time is more than 5 minutes.

③ Drying the stirred mixture of powder for more than 60 minutes at room temperature.

④ 0.5 wt % of lubricant is added into the powder dried, wherein the lubricant is selected from zinc stearate or $MoS_2$.

⑤ Putting the dried powder into a mold of magnetic powder core and compacting into powder core under the pressure of >500 MPa.

⑥ Annealing the press-molded magnetic powder cores at temperatures ranging from $>T_c+20°$ C. and $<T_x-20°$ C., wherein the annealing time is 5~300 minutes.

⑦ Spray-painting the magnetic powder core.

Advantages of Low Core Loss Magnetic Powder Cores (1) Compared to existing technology, the insulating agent of the present invention is amorphous soft magnetic powder that has excellent soft magnetic properties in itself. The insulation property is provided because the surface of amorphous powder is seriously oxidated into non-conductive metallic oxides, wherein the major element is $Fe_2O_3$.

(2) The filled quantity of oxidate amorphous powder can be higher, i.e. between 4 wt % and 20 wt %. The core loss of magnetic powder core can meet specific demand by altering the filled quantity, meanwhile magnetic permeability does not decrease.

(3) By using amorphous powder instead of traditional insulating agent, magnetic permeability and core loss are improved simultaneously.

(4) Magnetic permeability and core loss of the magnetic powder core is improved simultaneously in a wider range of frequencies.

(5) The amorphous soft magnetic powder prepared is low-cost, thus the property of the magnetic powder core functioning as an insulating agent improves and the cost decreases simultaneously.

DETAILED DESCRIPTION OF THE INVENTION

Embodiment 1

Figure 1:
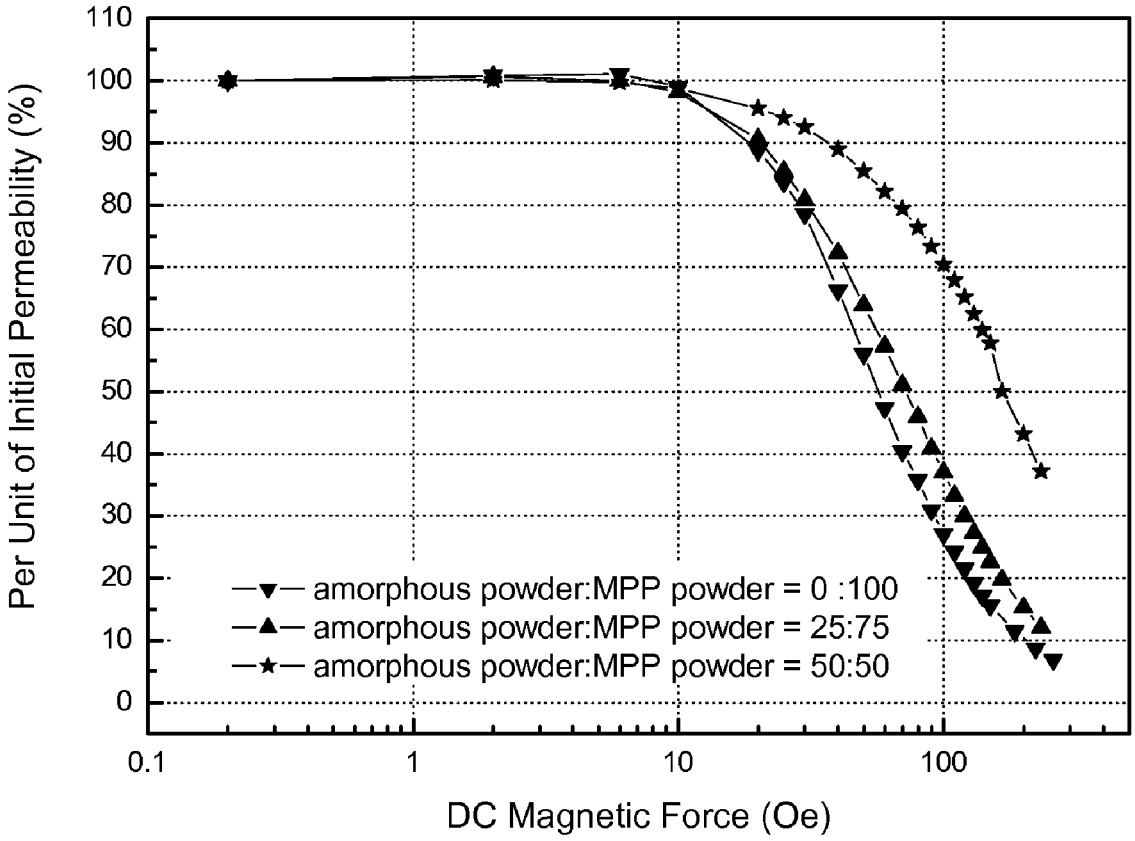
FIG. 1 is a curve graph illustrating the change of unit magnetic permeability of compound magnetic powder core prepared by mixing amorphous powder and MPP with different DC bias force.

In said embodiment, amorphous $Fe_{69}Ni_5Al_4Sn_2P_{10}C_2B_4Si_4$ alloy powder and MPP are prepared by water atomization method, wherein the pre-annealing technology of MPP is 650° C.×60 minutes; the pre-annealing technology of $Fe_{69}Ni_5Al_4Sn_2P_{10}C_2B_4Si_4$ powder is 450° C.×60 minutes and the annealing process is in a vacuum atmosphere. The powder of −300 mesh obtained by screening them respectively is used to prepare compound powder by mixing, wherein the mixing proportion is shown in Table 1.

TABLE 1

| | Mixing Proportion | | Inductance stability under DC bias condition | | | |
|---|---|---|---|---|---|---|
| Serial No. | Amorphous Powder | MPP Powder | Per Unit of initial magnetic permeability (50 Oe) | Increasing proportion (50 Oe) | Per Unit of initial magnetic permeability (100 Oe) | Increasing proportion (100 Oe) |
| 1 | 25% | 75% | 63.9% | 14.1% | 37.0% | 36.5% |
| 2 | 50% | 50% | 85.4% | 52.5% | 70.4% | 159.8% |
| Comparison 1 | 0 | 100 | 56.0% | — | 27.1% | — |

Said compound powder is uniformly mixed with 1.5 wt % of $SiO_2$ powder, 1 wt % of epoxy resin and 0.3 wt % of zinc stearate and then the mixture is fully dried, wherein alcohol is used as cosolvent during mixing. A pressure of 2000 MPa is adopted to press-mold the powder. The magnetic powder core is annealed in vacuum state. The annealing temperature is 400° C. and the annealing time is 90 minutes. The epoxy resin and estrodur compounds are used to spray-paint the surface of magnetic powder core. The thickness of spray-painting layer is 100 μm.

FIG. 1 exhibits the change of magnetic permeability of magnetic powder core prepared by the method mentioned above with different DC bias force. As shown in the figure, the Inductance stability under DC bias condition of compound magnetic powder core increases obviously with the increase of filled quantity of amorphous powder compared with that of the MPP powder core. Under a DC bias force of 50 Oe, when the content of amorphous powder is 25 wt %, specific magnetic permeability increases by 14.1%; when the content of amorphous powder is 50 wt %, specific magnetic permeability increases by 52.5%.

Moreover, when 25 wt % amorphous powder is added the price of the raw materials of magnetic powder core decrease by 10% or more. Therefore, the Inductance stability under DC bias condition of the compound magnetic powder core prepared by mixing MPP and amorphous powder increases, costs decreases, and the integrated requirement characteristics of the magnetic powder core are improved when compared to MPP.

Embodiment 2

In the embodiment, amorphous $Fe_{69}Ni_5Al_4Sn_2P_{10}C_2B_4Si_4$ alloy powder is prepared by water atomization method. The process for preparing nanocrystalline $Fe_{73.5}Cu_1Nb_3Si_{13.5}B_9$ alloy powder comprises: 1. preparing amorphous alloy strip by rapid quenching with a single roll; 2. isothermal annealing for 30 minutes at a temperature of 550° C. in a nitrogen atmosphere; 3. obtaining nanocrystalline powder by ball-milling using a planetary ball mill. Wherein the pre-annealing technology of $Fe_{69}Ni_5Al_4Sn_2P_{10}C_2B_4Si_4$ powder is 450° C.×60 minutes and the annealing process is in a vacuum atmosphere; the annealing technology of nanocrystalline powder is 550° C.×30 minutes and the annealing process is in nitrogen atmosphere. The amorphous $Fe_{69}Ni_5Al_4Sn_2P_{10}C_2B_4Si_4$ of −400 mesh and nanocrystalline powder of −100 mesh~+200 mesh screened respectively are used to prepare compound powder by mixing, wherein the mixing proportion is shown in Table 2.

TABLE 2

| Serial No. | Mixing Proportion: Amorphous Powder | Mixing Proportion: Nanocrystalline powder | Increasing proportion of quality factor: 100 kHz | Increasing proportion of quality factor: 500 kHz | Increasing proportion of specific magnetic permeability: 100 kHz | Increasing proportion of specific magnetic permeability: 500 kHz |
|---|---|---|---|---|---|---|
| 3 | 10% | 90% | 96.1% | 207.7% | 0.5% | 0.8% |
| 4 | 25% | 75% | 125.8% | 594.8% | 0.5% | 0.5% |
| 5 | 50% | 50% | 127.3% | 666.7% | 10.1% | 11.3% |
| 6 | 75% | 25% | 114.8% | 828.0% | 11.2% | 11.1% |
| Comparison 2 | 0 | 100% | — | — | — | — |

Said compound powder is uniformly mixed with 2 wt % of $SiO_2$ powder, 1 wt % of epoxy resin and 0.3 wt % of zinc stearate and then the mixture is fully dried, wherein alcohol is used as cosolvent during mixing. A pressure of 2000 MPa is adopted to press-mold the powder. The magnetic powder core is annealed in a vacuum. The annealing temperature is 400° C. and the annealing time is 90 minutes. The epoxy resin and estrodur compounds are used to spray-paint the surface of magnetic powder core. The thickness of spray-painting layer is 100 μm.

Figure 2:
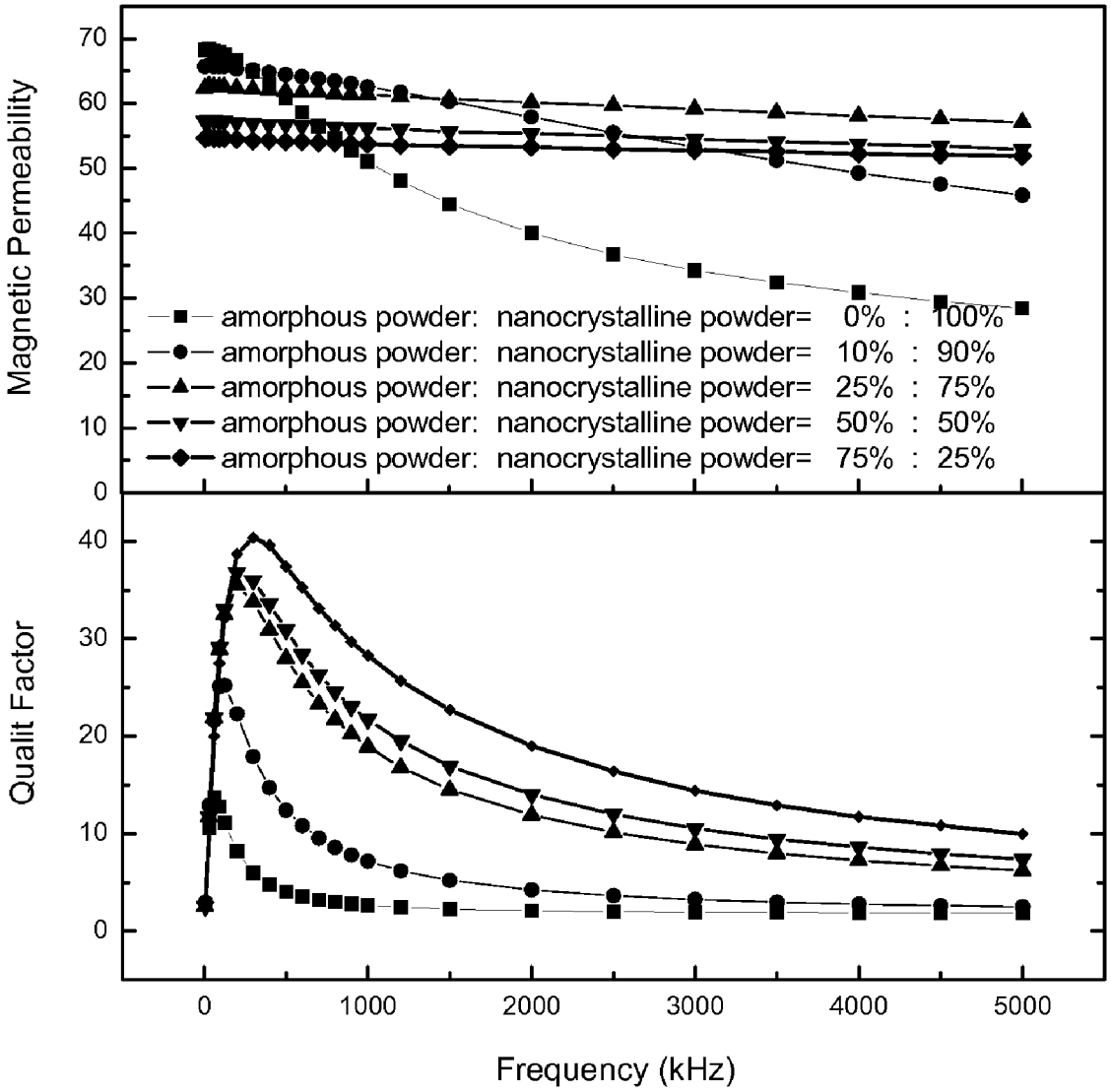
FIG. 2 is a curve graph illustrating the change of magnetic permeability and quality factor of compound magnetic powder core prepared by mixing nanocrystalline powder and amorphous powder in different frequencies.

FIG. 2 exhibits the change curve of magnetic permeability and quality factor of magnetic powder core prepared by the method mentioned above in different frequencies. As shown in the figure, by adding amorphous powder, the quality factor of the magnetic powder core increases obviously and Per Unit of initial magnetic permeability of the magnetic powder core are improved, but magnetic permeability decreases a little. Table 2 provides a list of concrete data of increasing proportion of quality factor and specific magnetic permeability of compound powder cores in 100 kHz and 500 kHz and those of nanocrystalline powder cores for comparison. When 10 wt % amorphous powder is added, the quality factor increases by over 90%. Therefore, the quality factor of the compound magnetic powder core prepared by mixing amorphous powder and nanocrystalline powder increases and the cost keeps the same, thus the integrated requirement characteristics of magnetic powder core is improved a lot.

Embodiment 3

In the embodiment, amorphous $Fe_{69}Ni_5Al_4Sn_2P_{10}C_2B_4Si_4$ alloy powder is prepared by water atomization method and Fe—Si—Al powder is prepared by crushing method. Wherein the pre-annealing technology of $Fe_{69}Ni_5Al_4Sn_2P_{10}C_2B_4Si_4$ powder is 450° C.×60 minutes and the annealing process is in a vacuum atmosphere. The annealing technology of Fe—Si—Al powder is 600° C.×30 minutes and the annealing process is in a hydrogen atmosphere. The amorphous $Fe_{69}Ni_5Al_4Sn_2P_{10}C_2B_4Si_4$ powder and Fe—Si—Al powder of −400 mesh screened respectively are used to prepare compound powder by mixing, wherein the mixing proportion is shown in Table 3. The process for preparing compound magnetic powder core is the same as mentioned in embodiment 2.

Figure 3:
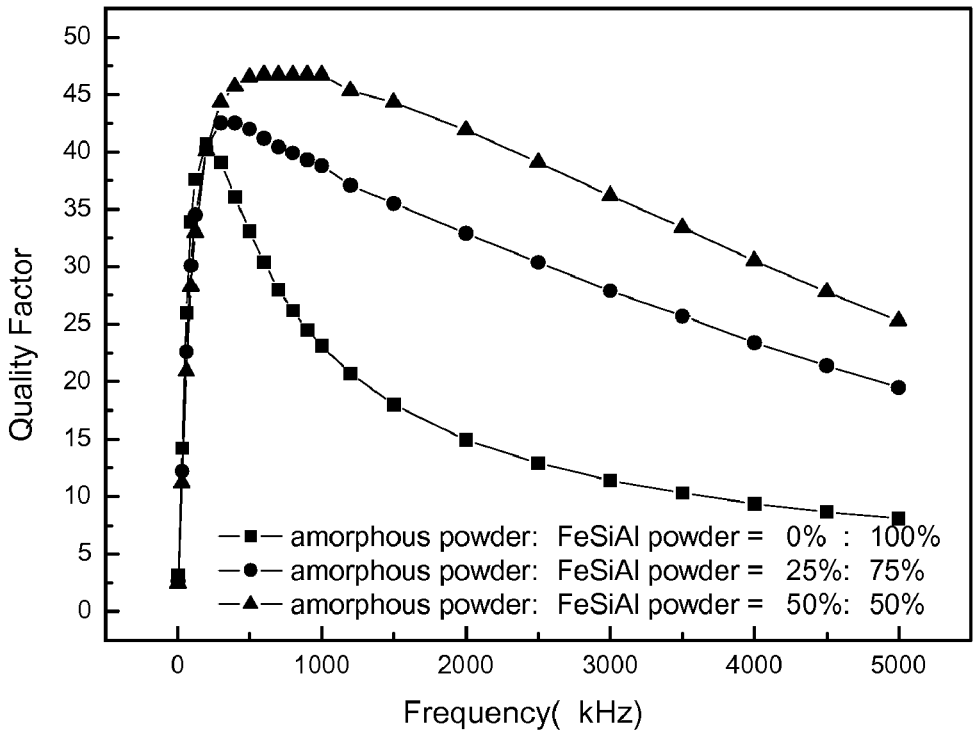
FIG. 3 is a curve graph illustrating the change of magnetic permeability and quality factor of compound magnetic powder core prepared by mixing amorphous powder and Fe—Si—Al powder in different frequencies.

FIG. 3 exhibits the quality factor of compound magnetic powder core and the quality factor of Fe—Si—Al powder core for comparison. It is concluded that the quality factor of magnetic powder core obviously increases by adding amorphous powder. Table 3 provides the lists of increasing percent of quality factor of compound powder core when filled quantity is 25 wt % and 50 wt % respectively and that of quality factor of Fe—Si—Al powder core under 1 MHz and 3 MHz for comparison. It is concluded that quality factor respectively increases by 68.0% and 102.2% under 1 MHz; while under 3 MHz quality factor respectively increases by 144.7% and 217.5%. Comparing with that of the original Fe—Si—Al powder core, the price of the compound magnetic powder core increases a little. Therefore, the quality factor of the compound magnetic powder core prepared by mixing amorphous powder and Fe—Si—Al powder increases obviously but the cost increases a little with the requirement characteristics of the magnetic powder core improved.

TABLE 3

| Serial No. | Mixing Proportion: Amorphous Powder | Mixing Proportion: Fe—Si—Al Powder | Increasing proportion of quality factor: 1 MHz | Increasing proportion of quality factor: 3 MHz |
|---|---|---|---|---|
| 7 | 25% | 75% | 68.0% | 144.7% |
| 8 | 50% | 50% | 102.2% | 217.5% |
| Comparison 3 | 0 | 100% | — | — |

Embodiment 4

In the embodiment, Hi-Flux powder is prepared by water atomization method and Fe—Si—Al powder is prepared by a crushing method. Wherein the pre-annealing technology of Hi-Flux powder is 650° C.×60 minutes and the annealing process is in hydrogen atmosphere; the annealing technology of Fe—Si—Al powder is 600° C.×30 minutes and the annealing process is in hydrogen atmosphere. The Hi-Flux powder and Fe—Si—Al powder of −400 mesh screened respectively are used to prepare compound powder by mixing, wherein the mixing proportion is shown in Table 4.

TABLE 4

| Serial No. | Mixing Proportion: Fe—Si—Al Powder | Mixing Proportion: High-Flux Powder | Increasing proportion of quality factor: 1 MHz | Increasing proportion of quality factor: 3 MHz |
|---|---|---|---|---|
| 9 | 50% | 50% | 102.2% | 217.5% |
| Comparison 3 | 0 | 100% | — | — |

Said compound powder is uniformly mixed with 2 wt % of $SiO_2$ powder, 1 wt % of epoxy resin and 0.3 wt % of zinc stearate and then the mixture is fully dried, wherein alcohol is used as cosolvent during mixing. A pressure of 2000 MPa is adopted to press-mold the powder. The magnetic powder core is annealed in a vacuum. The annealing temperature is 550° C. and the annealing time is 30 minutes. The epoxy resin and estrodur compounds are used to spray-paint the surface of magnetic powder core. The thickness of spray-painting layer is 100 μm.

Figure 4:
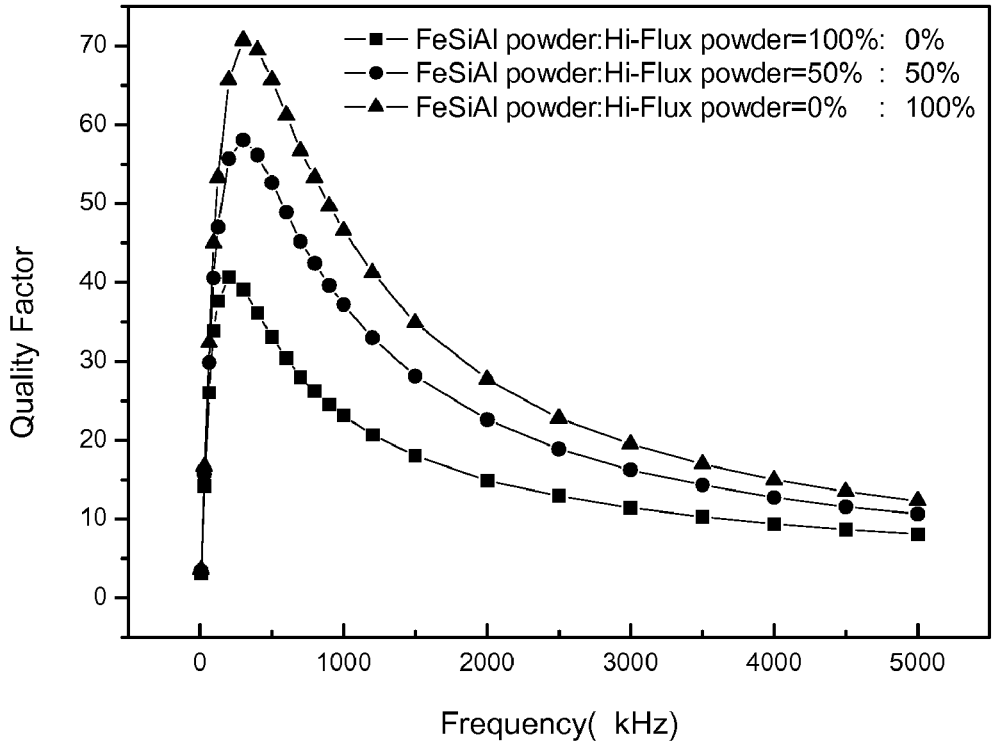
FIG. 4 is a curve graph illustrating the change of quality factor of compound magnetic powder core prepared by mixing Fe—Si—Al powder and Hi-Flux powder in different frequencies.
Figure 5:
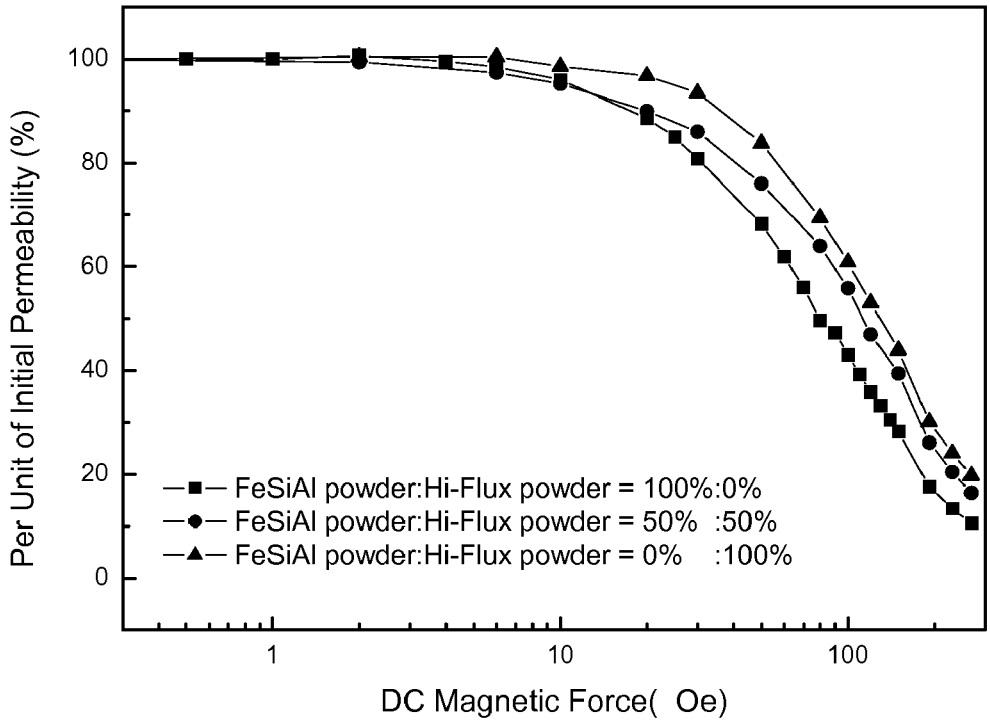
FIG. 5 is a curve graph illustrating the change of specific magnetic conductivities of compound magnetic powder core prepared by mixing Fe—Si—Al powder and Hi-Flux powder with different DC bias force.

FIG. 4 exhibits the quality factor of compound magnetic powder core and the quality factor of Fe—Si—Al powder core and that of Hi-Flux powder core for comparison. It is concluded that the quality factor in high frequencies and specific magnetic permeability under high DC bias force of compound magnetic powder core obviously increase when comparing with those of Fe—Si—Al powder cores. When comparing with those of Hi-Flux cores, the quality factor of high frequencies decreases a lot and specific magnetic permeability under high DC bias force decreases. Therefore, a magnetic powder core with an integrated and overall requirement characteristic is obtained by mixing Fe—Si—Al powder and Hi-Flux powder to prepare the compound magnetic powder core and partly replaces the Hi-Flux core.

Embodiment 5

In the embodiment, Hi-Flux powder and amorphous $Fe_{69}Ni_5Al_4Sn_2P_{10}C_2B_4Si_4$ alloy powder are prepared by water atomization, and Fe—Si—Al powder is prepared by crushing. Wherein the pre-annealing technology of amorphous powder is 450° C.×60 minutes and the annealing process is in a vacuum; the pre-annealing technology of Hi-Flux powder is 650° C.×60 minutes and the annealing process is in a hydrogen atmosphere. The annealing technology of Fe—Si—Al powder is 600° C.×30 minutes and the annealing process is in a hydrogen atmosphere. The amorphous $Fe_{69}Ni_5Al_4Sn_2P_{10}C_2B_4Si_4$, Hi-Flux and Fe—Si—Al powder of −400 mesh screened respectively are used to prepare compound powder by mixing, wherein the mixing proportion is shown in Table 5. The process for preparing compound magnetic powder core is the same as mentioned in embodiment 2.

TABLE 5

| Serial No. | Mixing Proportion: Amorphous Powder | Mixing Proportion: Fe—Si—Al Powder | Mixing Proportion: High-Flux Powder | Increasing proportion of quality factor 3 MHz |
|---|---|---|---|---|
| 10 | 50% | 30% | 20% | 93.8% |
| Comparison 3 | | 0 | 100% | — |

Figure 6:
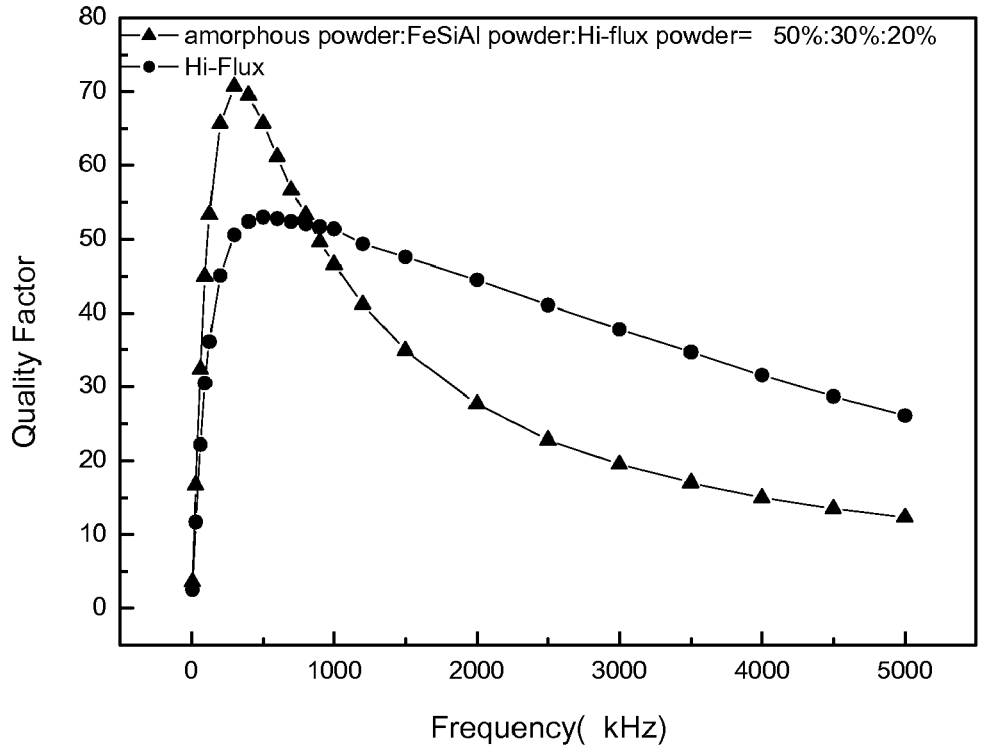
FIG. 6 is a curve graph illustrating the change of quality factor of compound magnetic powder core prepared by mixing amorphous, Fe—Si—Al and Hi-Flux powder and quality factor of Hi-Flux core in different frequencies.
Figure 7:
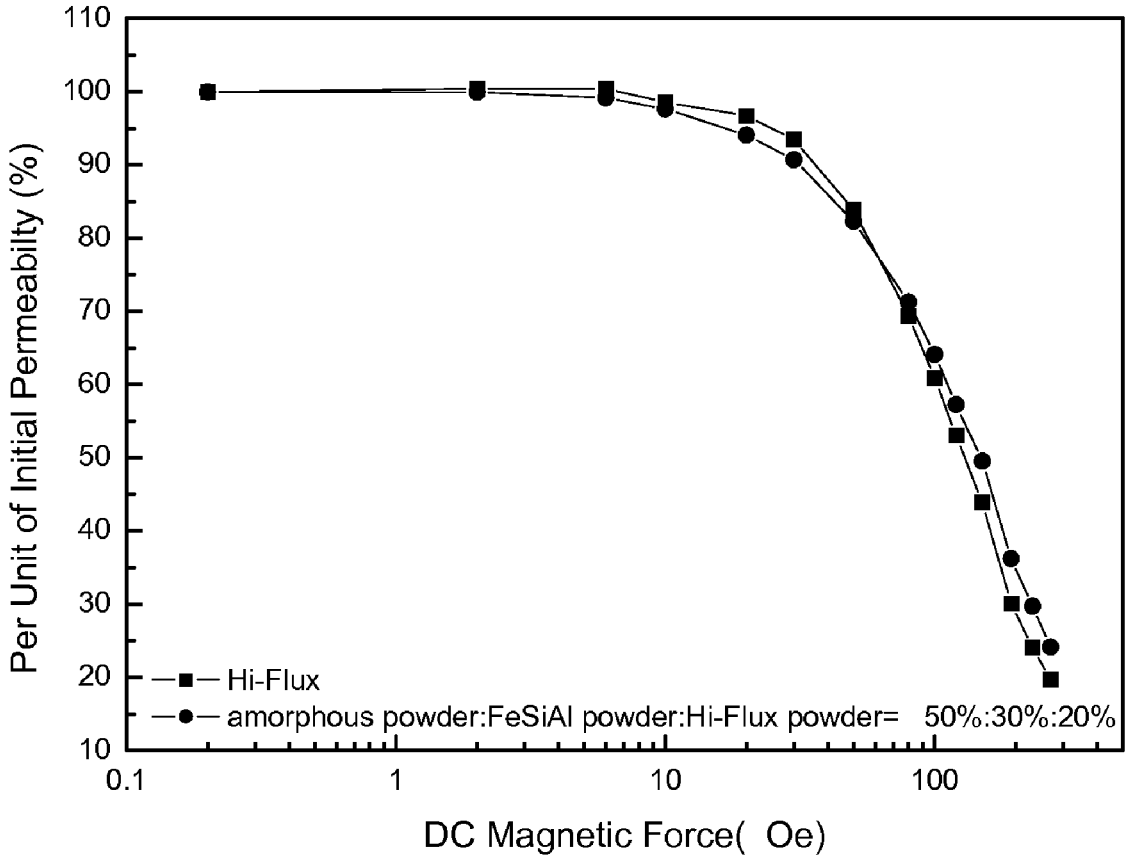
FIG. 7 is a curve graph illustrating the change of specific magnetic permeability of compound magnetic powder core prepared by mixing amorphous, Fe—Si—Al and Hi-Flux powder and that of Hi-Flux core with different DC bias force.
Figure 8:
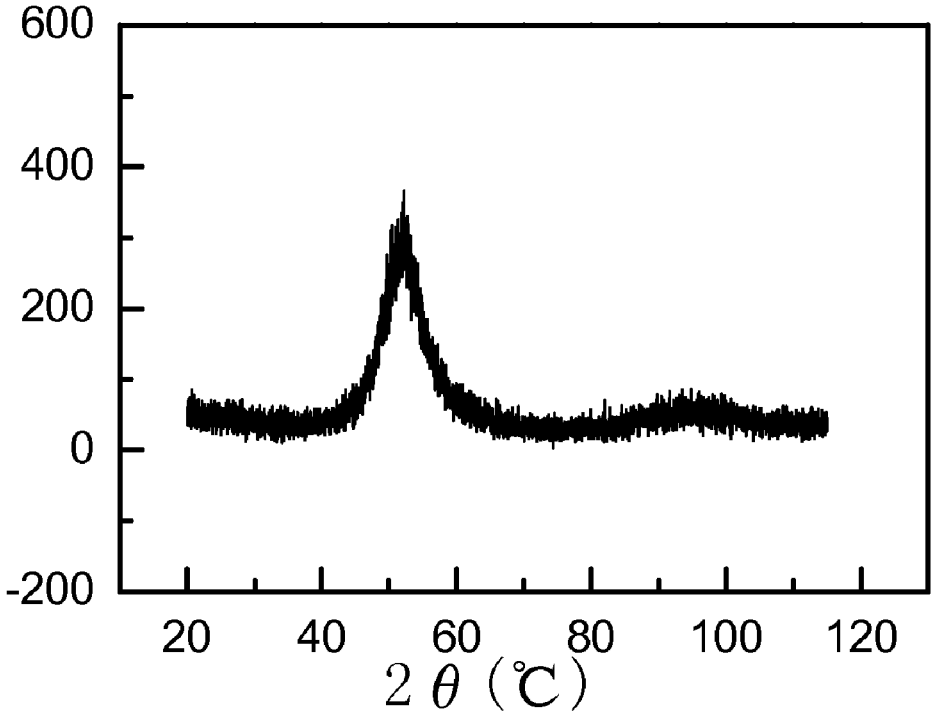
FIG. 8 is the X-ray diffraction pattern of amorphous magnetic powder functioning as insulation agent.
Figure 9:
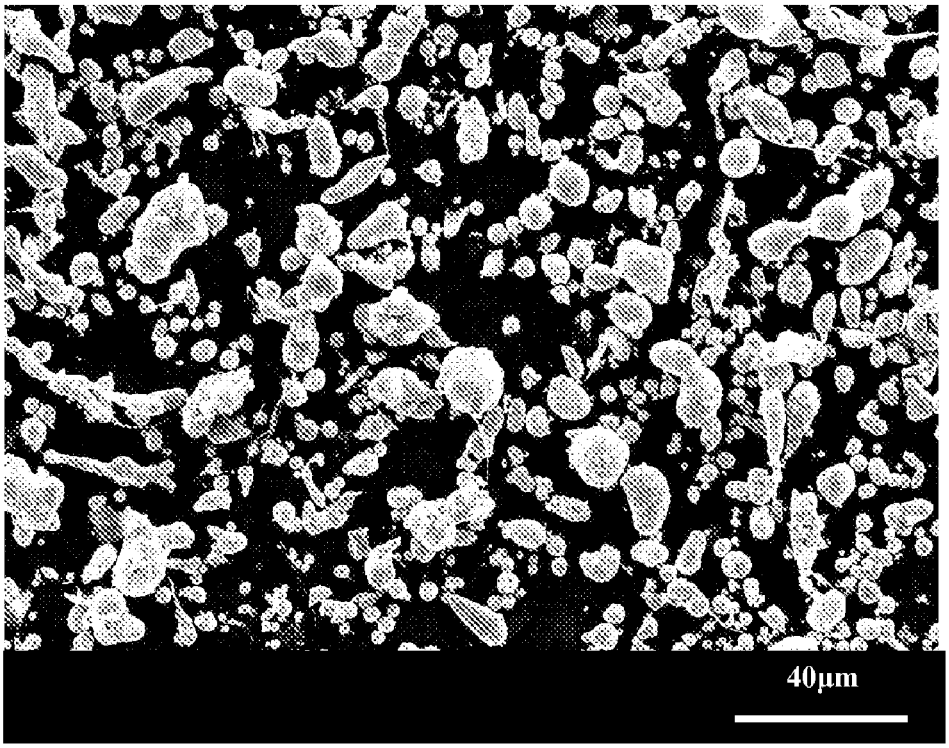
FIG. 9 is a photo of morphology of the powder mentioned in FIG. 8.
Figure 10:
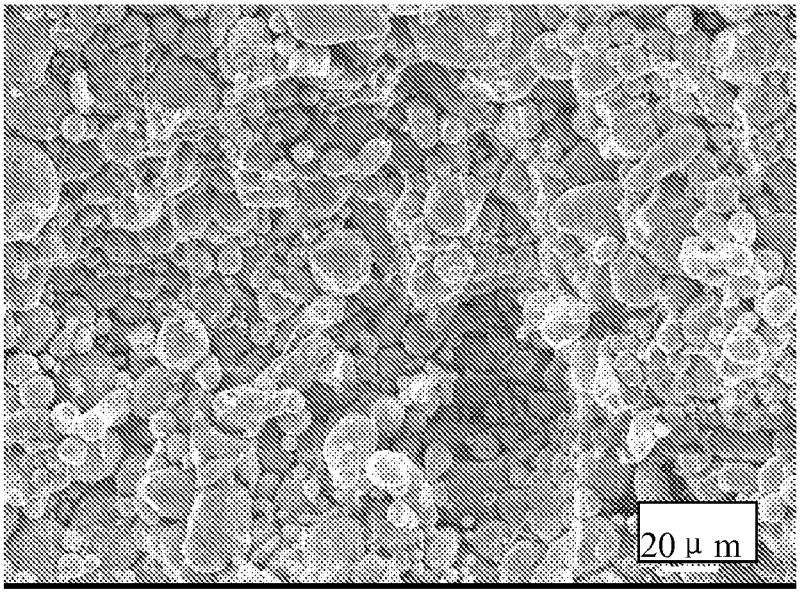
FIG. 10 is a cross-section view of magnetic powder core used to the process of making low core loss magnetic powder cores.

FIG. 6 exhibits the quality factor of compound magnetic powder core and the quality factor of Hi-Flux core for comparison. It is concluded that the quality factor of compound magnetic powder core in middle and low frequencies decreases. The quality factor in high frequencies increases and the quality factor under 3 MHz increases by 93.8% comparing with those of Hi-Flux core (shown in Table 5). FIG. 7 provides the change curve of specific magnetic permeability of compound magnetic powder core and that of High-Flux powder core for comparison under different DC bias force. As shown in the figure, the specific magnetic permeability of compound magnetic powder core is comparable to that of High-Flux powder core. Comparing with that of Hi-Flux core, the price of raw material of compound magnetic powder core decreases a lot. Therefore, the quality factor of magnetic powder core in high frequency of the compound magnetic powder core prepared by mixing Fe—Si—Al powder and Hi-Flux powder increases a lot and the cost decreases dramatically comparing with those of Hi-Flux core, thus a magnetic powder core with integrated and overall characteristics is obtained and replaces Hi-Flux core in high frequency.

Embodiment 6

Figure 11:
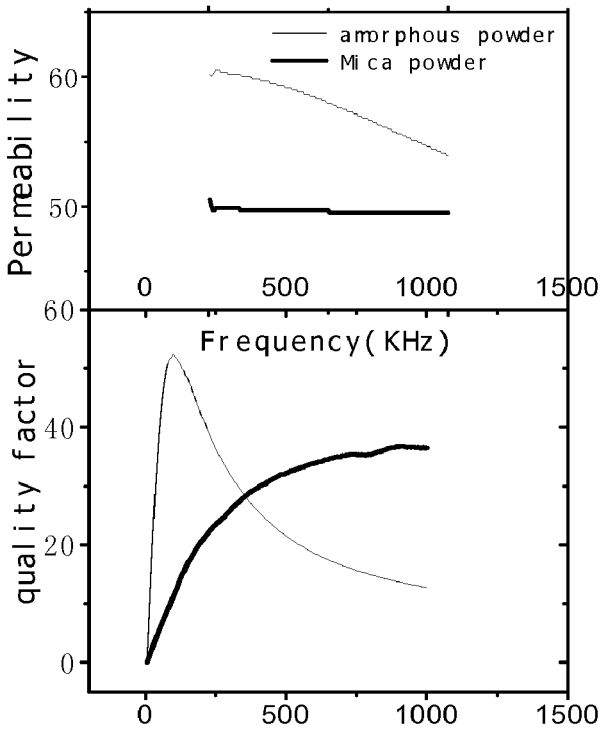
FIG. 11 is graph illustrating the dependence of on the result of modified MPP magnetic core according to embodiment 6.

4 wt % of amorphous insulating agent of −400 mesh is mixed with MPP of −400 mesh (oxygen content of amorphous powder is 9100 ppm) and then 1 wt % of adhesive is added. After the mixture is dried, ring-shape magnetic powder core is prepared under a pressure of 40 tons. Mica powder is used as an insulating agent to prepare MPP magnetic powder core for comparison. The preparation technology is the same as the process for preparing magnetic powder cores of an amorphous insulating agent. FIG. 11 and Table 6 exhibit the properties comparison after heat treatment of 440° C.×60 minutes.

It is analyzed from the result that by adding amorphous insulating agent, magnetic permeability increases and quality factor is also improved within a certain range, which indicates that the high oxygen content of amorphous insulating agent improves the core loss to some extent when amorphous insulating agent is 4 wt %, especially magnetic permeability decreases, while the increase of magnetic permeability mainly comes from the magnetic properties of amorphous insulating agent.

TABLE 6

The influence of amorphous powder and mica powder insulating agent on MPP

| Insulating agent | μ (100k) | μ (500k) | Q (100k) | Q (500k) |
|---|---|---|---|---|
| Amorphous powder | 60 | 58 | 52.4 | 21.5 |
| Mica powder | 50 | 50 | 11.2 | 32.2 |

Embodiment 7

MPP of −400 mesh is mixed with 10 wt % of amorphous insulating agent of −400 mesh to prepare magnetic powder core, and then MPP of −400 mesh is mixed with 10 wt % of mica powder of −400 mesh. The same technology is used to prepare magnetic powder core. The amorphous oxygen content is 9100 ppm. The result is shown in FIG. 12.

Figure 12:
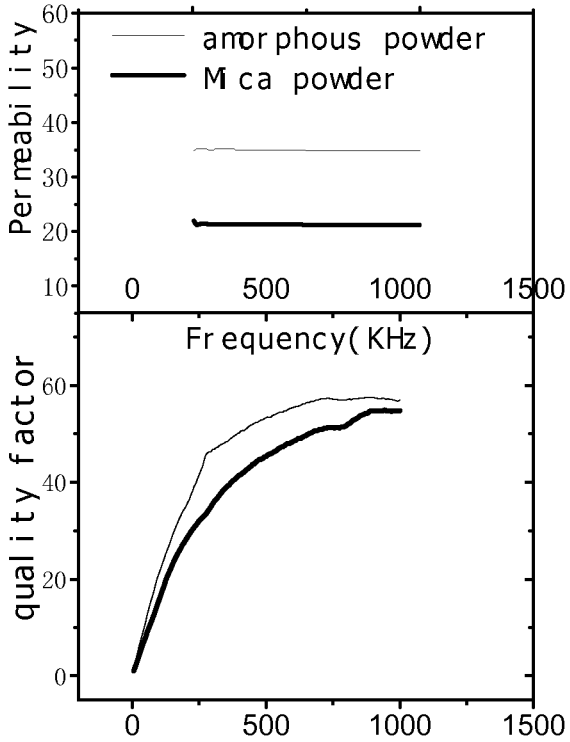
FIG. 12 is the result of modified MPP magnetic core according to embodiment 7.

FIG. 12 exhibits the quenching result. It is concluded that while the core loss of magnetic powder core increases, the magnetic permeability increases a lot, Per Unit of initial magnetic permeability are fine and permeability is nearly constant.

To combine embodiment 6 and 7, it is concluded that only if the content of insulating agent of amorphous powder gets at a certain amount, magnetic permeability, Per Unit of initial magnetic permeability and core loss are improved simultaneously. The preferable solution is 8~15 wt %.

Embodiment 8

Figure 13:
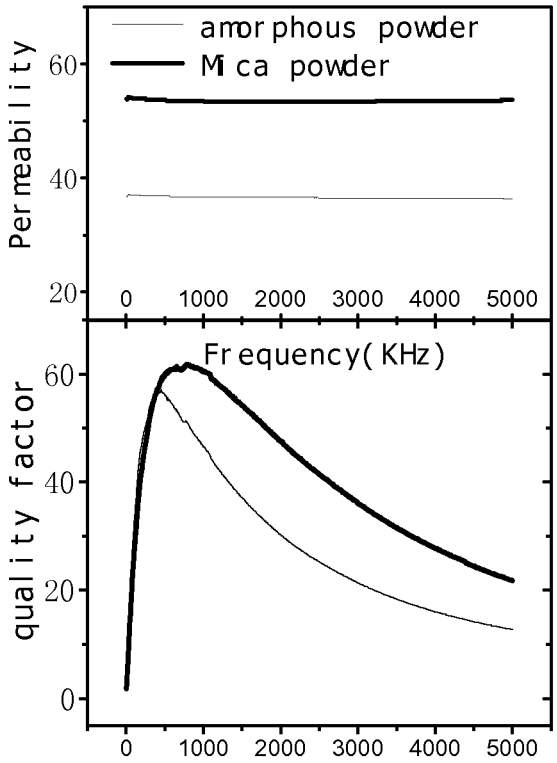
FIG. 13 is the result of modified amorphous magnetic powder core according to embodiment 8.

Amorphous powder of −300~+400 mesh is respectively mixed with 10 wt % of amorphous insulating agent of −400 mesh with same composites and 10 wt % of mica powder insulating agent respectively to prepare magnetic powder core. The amorphous oxygen content of −400 mesh is 10000 ppm and the oxygen content of amorphous powder of −300~+400 mesh is 4000 ppm. The annealing result in 440° C.×60 minutes is shown in FIG. 13.

The result shows that by adopting an amorphous insulating agent, not only magnetic permeability increases on the basis of the magnetic powder core of traditional insulating agent, but also core loss decrease dramatically, especially when in high frequencies. The Per Unit of initial magnetic permeability are fine, and permeability is nearly constant.

Embodiment 9

Figure 14:
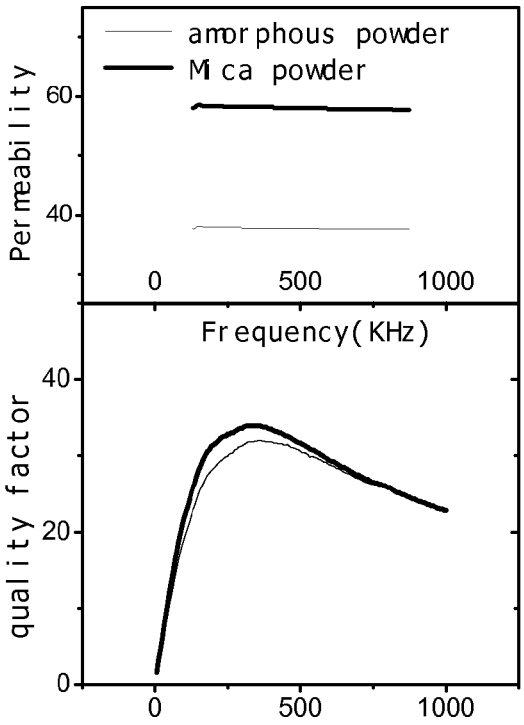
FIG. 14 is the result of modified amorphous magnetic powder core according to embodiment 9.

Amorphous powder of −300~+400 mesh is respectively mixed with 10 wt % of amorphous insulating agent of −400 mesh with same components and 10 wt % of mica powder insulating agent to prepare magnetic powder core. The amorphous oxygen content of −400 mesh is 5000 ppm and the oxygen content of amorphous powder of −300~+400 mesh is 3000 ppm. The composites of amorphous powder are the same as mentioned in embodiment 8. The annealing result in 440° C.×60 minutes is shown in FIG. 14.

The result shows that by adopting amorphous insulating agent, the magnetic permeability increases on the basis of the magnetic powder core of traditional insulating agent, Per Unit of initial magnetic permeability are fine, permeability is nearly constant and core loss decreases a little at the same time, which mainly originates from soft magnetic properties of insulating agent of amorphous soft magnetic powder and high oxygen content.

To combine embodiment 8 and 9, it is concluded that: only if the oxygen content of amorphous powder functions as an insulating agent is high, magnetic permeability and core loss are improved simultaneously. The oxygen content is preferably 8000~11000 ppm.

Embodiment 10

Figure 15:
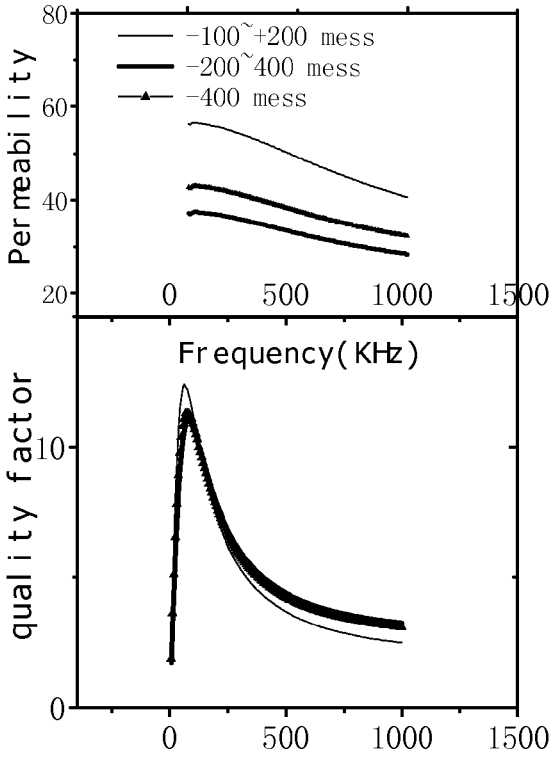
FIG. 15 is the result of modified nanocrystalline magnetic powder core according to embodiment 10.

The embodiment is a comparison of effect of different particle size rates on properties of magnetic powder core. To be specific, 20 wt % of amorphous insulating agent powder of −400 mesh is mixed with nanocrystalline powder of −100~+200, −200~+400, ~400 mesh respectively, wherein the content of adhesive is 1 wt %, then the mixture is molded under a pressure of 2000 MPa. The oxygen content of insulating agent is 10000 ppm. The quenching result is shown in FIG. 15.

Although the increase in particle size of the nanocrystalline powder leads to the increase of magnetic powder core eddy current loss, the result shows the quality factor does not decrease within measuring range, which in fact indicates the improvement of insulation effect; likewise magnetic permeability increases without increasing core loss. It is just the technical characteristics for the present invention.

The solution to particle size rate between amorphous insulating agent powder and magnetic powder is preferably ⅓~⅛.

TABLE 7

The influence of amorphous soft magnetic insulating agent on nanocrystalline magnetic powder core of different particle sizes

| Nanocrystalline | μ (100k) | μ (500k) | Q (100k) | Q (500k) |
|---|---|---|---|---|
| −100~200 mesh | 55 | 48 | 9.0 | 5.1 |
| −200~400 mesh | 45 | 43 | 9.0 | 4.8 |
| ~400 mesh | 35 | 34 | 9.0 | 5.3 |

We claim:

1. A compound powder for making magnetic powder cores comprising a mixture of powder A and powder B, the content of powder A is 50-96 wt % and the balance is powder B; powder A is Fe-based nanocrystalline powder, powder B is Fe-based amorphous powder with electrical insulating properties; wherein:

the composition of said powder B satisfies $(Fe_{1-x}M_x)_{100-a-b-c}P_aT_bD_c$; wherein M represents at least one element of Co and Ni; T consists of Al, C, B, Si; D is at least one element selected from Sn, Cr, Mn, Mo, W, V, Nb, Ta, Ti, Zr, Hf, Pt, Pd, Au; x is from 0.01 to 0.16; a is from 8 to 15; b is from 10 to 25; c is from 0.5 to 6, and all by atomic percentage;

said amorphous powder B is oxidated on its surface and the oxygen content is 4000-20000 ppm;

said powder A is crushed nanocrystalline strip.

2. A magnetic powder core comprising the following weight percentages: 0.2 wt %-7 wt % of insulating agent, 0.1 wt-5 wt % of adhesive, 0.01 wt-2 wt % of lubricant, the balance comprising the compound powder according claim 1.

3. The magnetic powder core according to claim 2, wherein said insulating agent is at least one selected from the following groups of substances:

Oxide powder selected from $SiO_2$, CaO, $Al_2O_3$, $TiO_2$;

Salts selected from silicates and phosphates;

Mineral powder selected from mica powder and kaolinite.

4. The magnetic powder core according to claim 2, wherein said adhesive is organic adhesive or inorganic adhesive, wherein the organic adhesive is at least one selected from epoxy resin, and the inorganic adhesive is at least one selected from phosphates.

5. The magnetic powder core according to claim 2, wherein said lubricant is at least one selected from stearates, talc powder and $MoS_2$.

6. The magnetic powder core according to claim 2, wherein the content of said insulating agent is 0.5-5 wt %.

7. A compound powder for making low core loss magnetic powder cores, comprising a mixture of powder A and powder B wherein the content of powder A is 80-96 wt % and powder B is 4-20 wt %, wherein powder A is Fe-based nanocrystalline soft magnetic powder, and powder B is Fe-based amorphous powder with electrical insulating properties; wherein:

the composition of said amorphous powder B satisfies $(Fe_{1-x}M_x)_{100-a-b-c}P_aT_bD_c$; wherein M represents at least one element of Co and Ni; T consists of Al, C, B, Si; D is at least one element selected from Sn, Cr, Mn, Mo, W, V, Nb, Ta, Ti, Zr, Hf, Pt, Pd, Au; x is from 0.01 to 0.16; a is from 8 to 15; b is from 10 to 25; c is from 0.5 to 6, and all by atomic percentage;

said amorphous powder B is oxidated on its surface and the oxygen content is 4000-20000 ppm;

said powder A is crushed nanocrystalline strip.

8. The compound powder for making the low core loss magnetic powder cores according to claim 7, wherein said powder B is Fe-based amorphous soft magnetic powder oxidated on its surface, wherein the oxygen content is 8000-11000 ppm.

* * * * *